US005575622A

United States Patent [19]

Zimmerman et al.

[11] Patent Number: 5,575,622

[45] Date of Patent: Nov. 19, 1996

[54] METHOD AND APPARATUS FOR MOUNTING A FAN GUARD

[75] Inventors: Leon S. Zimmerman, Lititz; Bryan S. Shive, Myerstown, both of Pa.

[73] Assignee: Staco, Inc., Schaefferstown, Pa.

[21] Appl. No.: 357,422

[22] Filed: Dec. 16, 1994

[51] Int. Cl.[6] ..... F04D 29/52

[52] U.S. Cl. ..... 415/213.1; 415/223

[58] Field of Search ..... 416/247 R; 415/121.2, 415/213.1, 220, 223

[56] References Cited

U.S. PATENT DOCUMENTS

| | | | |
|---|---|---|---|
| 2,036,478 | 4/1936 | Hoff . | |
| 2,571,726 | 10/1951 | Koch . | |
| 3,123,288 | 3/1964 | Franklin | 415/220 |
| 3,629,868 | 12/1971 | Greenlee | 416/247 R |
| 3,787,142 | 1/1974 | Dupke . | |
| 4,064,427 | 12/1977 | Hansen et al. | 416/247 R |
| 4,120,615 | 10/1978 | Keem et al. | 415/121.2 |
| 4,353,680 | 10/1982 | Hiraoka et al. | 415/223 |
| 4,406,216 | 9/1983 | Hott et al. | 415/213.1 |
| 4,818,183 | 4/1989 | Schaefer . | |
| 4,834,615 | 5/1989 | Mauch et al. | 415/213.1 |
| 4,861,230 | 8/1989 | Breining . | |
| 5,002,462 | 3/1991 | Janisse . | |
| 5,073,088 | 12/1991 | Peng . | |
| 5,221,180 | 6/1993 | Crider | 416/247 R |
| 5,240,378 | 8/1993 | Janisse et al. | 416/247 R |
| 5,344,287 | 9/1994 | Schaefer | 415/213.1 |

FOREIGN PATENT DOCUMENTS

| | | | |
|---|---|---|---|
| 6721777 | 6/1942 | Germany | 415/223 |

*Primary Examiner*—Edward K. Look
*Assistant Examiner*—Mark Sgantzos
*Attorney, Agent, or Firm*—John G. Mills and Associates

[57] ABSTRACT

This invention is a quick attach fan guard for shroud type fans. A plurality of L-shaped slots are provided in the front and rear edges of the shroud with hooks with bends in the same are mounted on the fan guard so such bends lie a juxtaposed parallel plane to the interior of the shroud and the hooks engage the slots with such guard being rotated to lock the same to the shroud. At least one bolt is used to prevent undesirable counterrotation which might disconnect the guard from the shroud. Also malletable tabs are provided in a connector plate for the shroud to support the fan when used as a circulating fan. When the fan is used as an exhaust fan, a hook is mounted on the connecting plate for engaging an angle bracket on an adapter plate with a circular opening therein. Pivotable tabs mounted on the interior edges of the shroud engage the circular opening in the adapter plate. The same tabs are also used to stabilize two or more fans when they are stacked during storage and transport.

14 Claims, 6 Drawing Sheets

METHOD AND APPARATUS FOR MOUNTING A FAN GUARD

FIELD OF INVENTION

This invention relates to circulating and exhaust fans and more particularly the mounting of front and rear fan guards on fan encircling shrouds.

Since the initial development fans used to move air, particularly high speed fans, there has been concern over how to prevent accidental contacting of the fan blades without unduly impeding the air flow.

Fans over the years have become more sophisticated as well as safer due at least in part to national and international safety standards that are now in place.

One of the latest types of fans used in the agribusiness and other areas where there is a need to move large volumes of air, is a fan mounted within a cylindrical shaped shroud with wire guards covering each end of the shroud. These wire guards have heretofore usually included outwardly radiating ribs with eyelets formed in the ends thereof for bolting to the shroud. This method of attaching guards is labor intensive and time consuming in that a bolt or other securing means must be passed through the guard eyelet as well as through an opening in the shroud and then secured thereto.

CONCISE EXPLANATION OF PRIOR ART

U.S. Pat. No. 4,861,230to Fran E. Breining is considered of interest in that it discloses an interlocking fan guard with tabs that line up with a bolt that holds the same together.

U.S. Pat. No. 5,002,462to Dwight C. Janisse is considered of interest in that it discloses a hinged and quick mount guard for electric fans including a plurality of slotted openings for engaging the head of self-locking nuts.

U.S. Pat. Nos. 4,818,183to Ronald E. Schaefer and 3,787,142 to Roger C. Dupke are both considered of interest in that they disclose fan guards that snap together.

U.S. Pat. No. 2,571,726to Gustav H. Koch is considered of interest in that it discloses a removable grill for a ventilating fan that snaps in and out of place.

Finally, U.S. Pat. Nos. 2,036,478to Charles E. Hoff and 5,073,088to Johnson Peng are both considered of general interest in that they disclose additional fan guards and associated means for holding the same together.

BRIEF DESCRIPTION OF INVENTION

After much research and study into the above mentioned problems, the present invention has been developed to provide a twist-on fan guard that interlocks with the shroud and is held against accidental unlocking by a bolt or other suitable means.

The shroud is constructed from corrosion proof polyethylene with a stainless steel connecting plate. A malleable tab is provided in the connecting plate adjacent what is considered the front guard of the fan for connection to a hanger mounted on an adapter plate with a circular opening therein. This hanging means is combined with a plurality of pivotable tabs mounted on the shroud that can be pivoted to outwardly extend beyond the periphery of such shroud to keep the same centered in the round opening. These tabs can also be used to allow a plurality of fans to be stacked vertically for storage and shipment prior to use. When not needed the tabs can be folded out of the way so that they do not project beyond the adjacent periphery of the shroud.

From the above it is an object of the present invention to provide a high-performance round shrouded fan with front and rear guards that are twist locked on the front and rear of the shroud.

Another object of the present invention is to provide a fan guard mounting system that twist locks into place.

Another object of the present invention is to provide metal fan guards that twist lock into place and are held against unlocking by single separable fastener.

Another object of the present invention is to provide a shrouded fan made from a corrosion proof material with a metal connector plate securing the edges thereof together.

Another object of the present invention is to provide a malleable tab in the connector plate so that the fan can be suspended and used as a circulating fan.

Another object of the present invention is to provide a shrouded fan with a hanger mounted adjacent one edge thereof to allow such fan to be mounted in the circular opening of a wall plate so that the fan can be used as an exhaust fan.

Another object of the present invention is to provide a shrouded fan with a plurality of tabs outwardly projecting from one periphery thereof to allow vertical stacking of a plurality of fans during storage and transportation.

Another object of the present invention is to provide, in a shrouded fan, a plurality of tabs outwardly projecting from one of the peripheries of said shroud to center the shrouded in the round opening of a wall plate.

Another object of the present invention is to provide a plurality of pivotal tabs mounted on the interior of a fan shroud adjacent one periphery thereof to allow a plurality of fans to be vertically stacked during storage and transportation and to keep the fans centered in a round opening of a wall plate when in use.

Other objects and advantages of the present invention will become apparent and obvious from a study of the following description and the accompanying drawings which are merely illustrative of such invention.

DETAILED DESCRIPTION OF INVENTION

Figure 1:
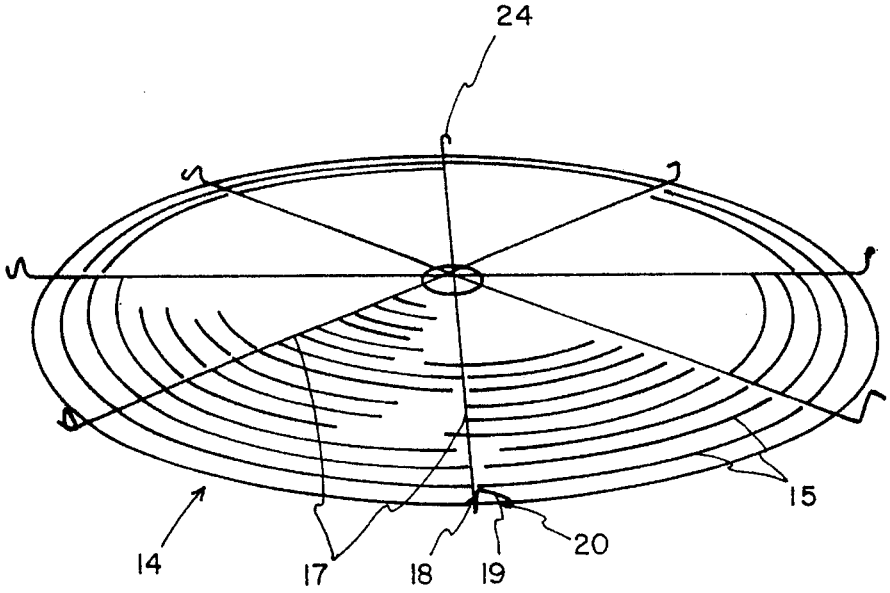
FIG. 1 is a perspective view of the interior of the quick attach fan guard for the improved shroud fan.
Figure 2:
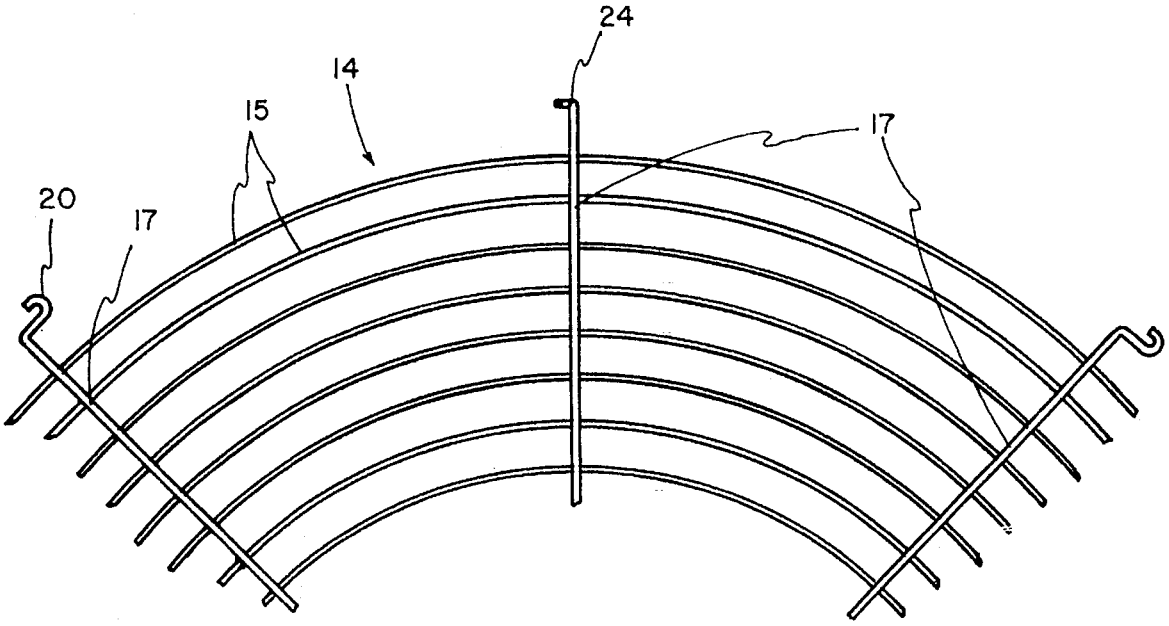
FIG. 2 is an enlarged plan view thereof.
Figure 3:
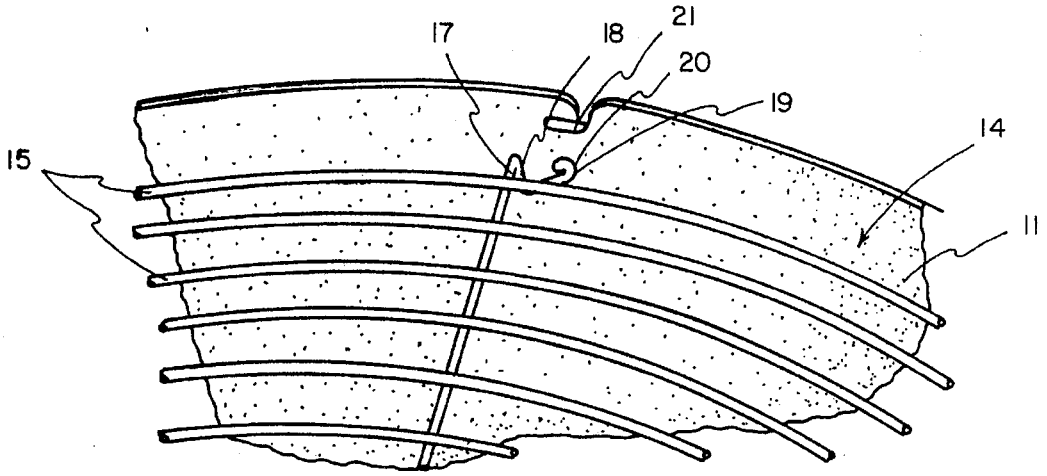
FIG. 3 is a perspective view of the quick attach fan guard adjacent a mating slot in the shroud.

The improved shroud fan of the present invention, indicated generally at 10, includes a shroud constructed from a corrosion proof material such as polyethylene. This shroud is cut from a sheet of planer material with the ends thereof pulled around until they are abutting. A stainless steel connecting plate 12 is secured along the end joint by any suitable means such as rivets 13.

Front and rear quick attach fan guards 14 are provided. These guards are composed of a plurality of concentric rings 15 that are spaced apart far enough to allow proper air flow and narrow enough to prevent appendages from touching the fan blades 16 operatively mounted within the fan. Since there are United States and International Safety Regulations relating to the size of openings in fan guards, further detailed discussion of this portion of the present invention is not deemed necessary.

A plurality of radial wires or rods 17 are secured by weldment or other suitable means to the concentric rings 15 as can clearly be seen in the drawings.

The outer ends of all but one of the radial wires are bent inwardly at 90 degrees to form inward arm portion 18. A second bend is formed in the ends of the radial arms 17 at a 60 degree outwardly direction to form outward arm 19. Both the inward arm portion 18 and the outward arm portion 19 lie in a plane parallel to the plane of the shroud.

A U-shaped hook portion 20 is formed in the end of each of the outward arm portion 19 and lies in a plane perpendicular to the plane of the shroud 11.

L-shaped slots 24 are formed in the front and rear edges 22 and 23 of the shroud 11. Each of these slots 21 correspond to one of the radiating wires 17.

Figure 6:
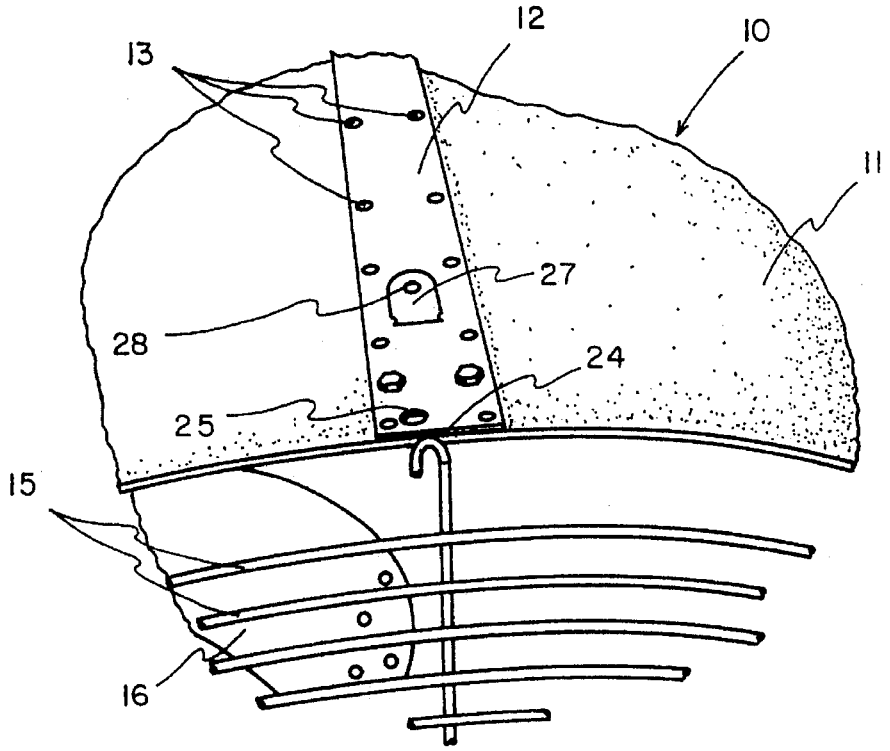
FIG. 6 is a perspective view showing the bolt preventing the guard from becoming disengaged from the shroud slot.

One of the radial wires 17 has a 90 degree inwardly bend with a U-shaped hook portion 24 formed in the end thereof as can clearly be seen in FIG. 6. An opening 25 is provided in each end of the connecting plate 12 and is adapted to receive fan guard locking bolt 26 which passes through the U-shaped hook portion 24.

Figure 7:
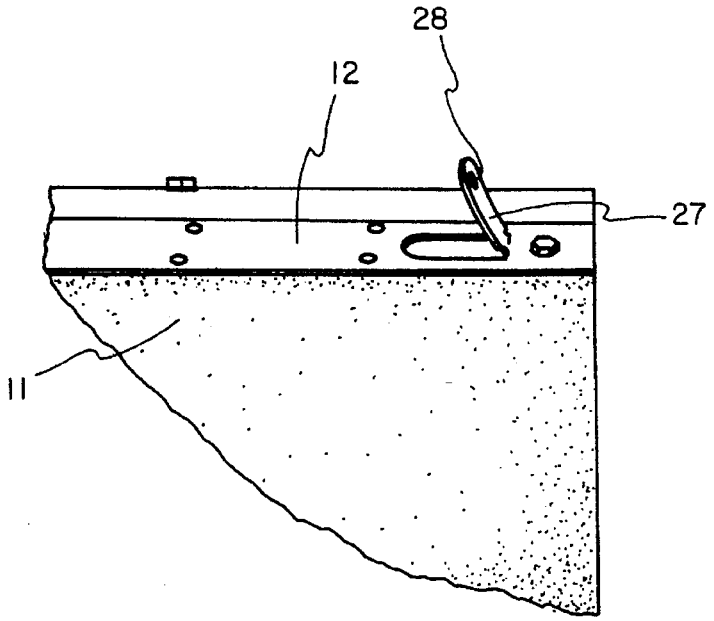
FIG. 7 is a perspective view of the malleable hanging tab being deployed.
Figure 8:
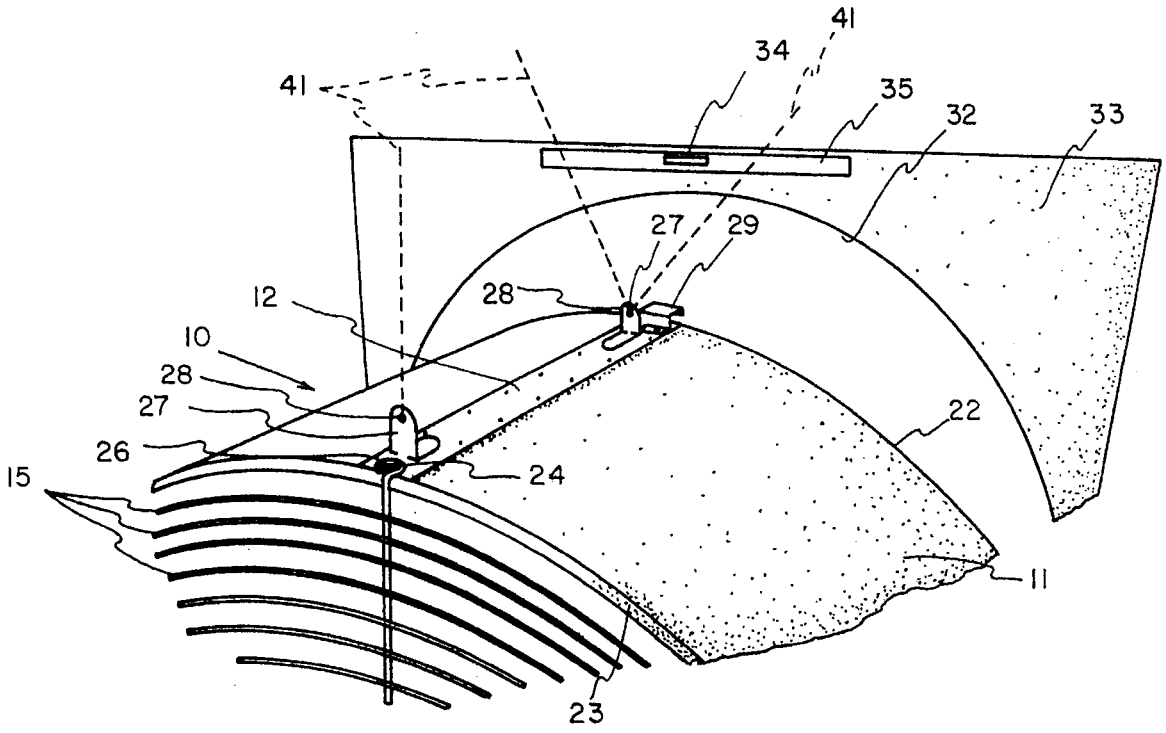
FIG. 8 is a perspective view illustrating the two methods of supporting the shroud fan.

A plurality of malleable tabs 27 are formed in each end of the connecting plate 12. These tabs are formed by laser cutting, stamping or other suitable means. An opening 28 is formed in the end of each of the tabs that are outwardly disposed when deployed as shown in FIGS. 7 and 8.

A hanging hook 29, which includes a lip 30, is secured to one end of connecting plate 12 by suitable means such as bolts 31.

Whenever the shroud fan 10 of the present invention is to be disposed in a circular opening 32 in a wall 33 having a slightly smaller diameter than the exterior diameter of the shroud 11, the hook 29 is used to engage slot 34 in angle bracket 35 mounted above the circular opening 32 to support the fan 10 juxtaposed to such opening.

A plurality of relatively small tabs 36 are riveted or otherwise mounted on the interior and exterior of the shroud 11 adjacent the front and rear edges 22 and 23. Each of these tabs is riveted tightly enough that friction will hold the same in place once the desired orientation has been made of such tab and yet is loose enough so that the tab can be moved from one orientation to another.

Figure 11:
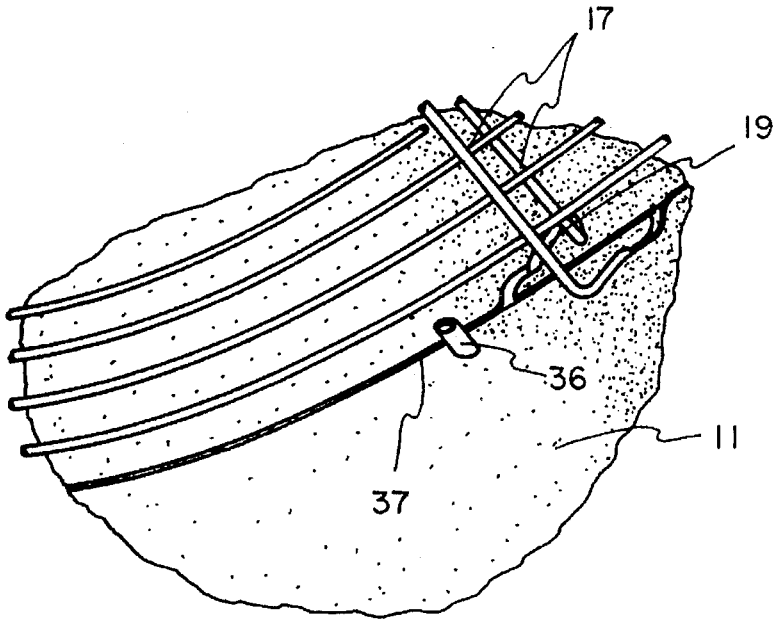
FIG. 11 is a perspective view showing the tab in use on stacked fans.
Figure 12:
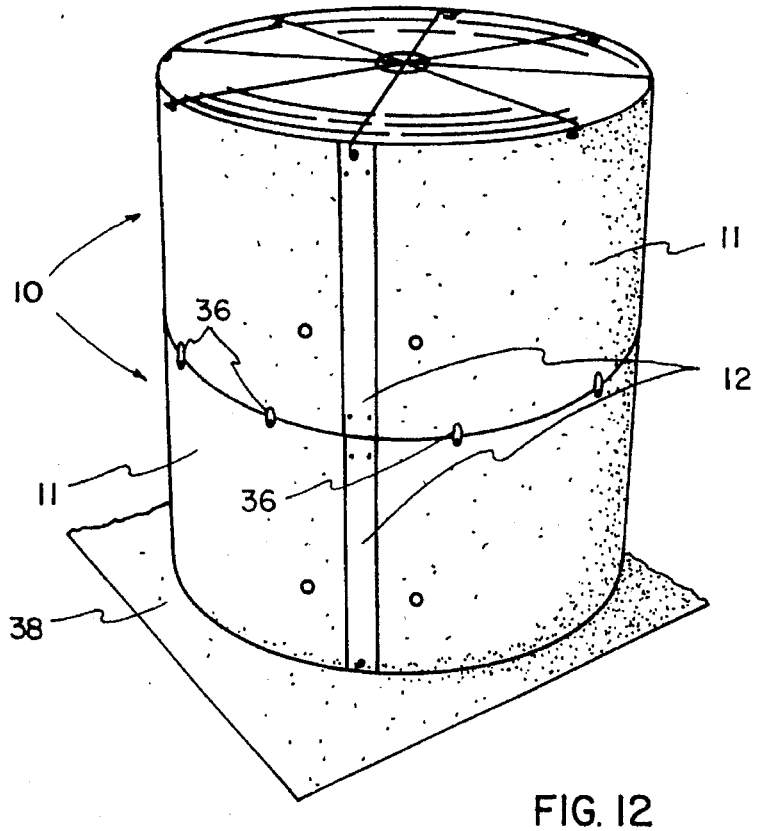
FIG. 12 is a perspective view of a pair of stacked shroud fans.
Figure 13:
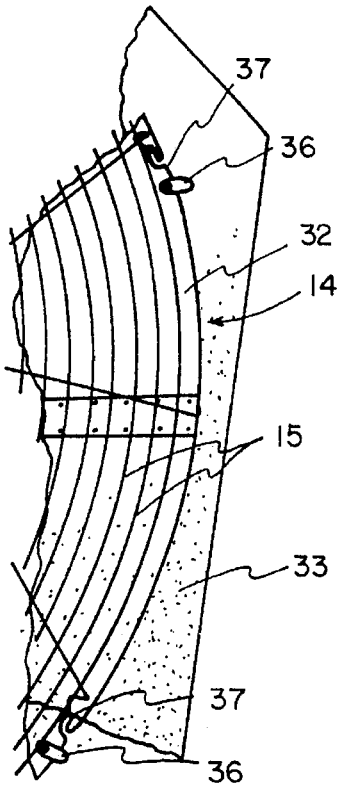
FIG. 13 is a perspective view of a fan mounted in a circular opening.

Ordinarily the tabs are disposed inwardly out of the way when not in use. Whenever it is desired to stack a plurality of fan as shown in FIG. 12, the tabs are pivoted outwardly to extend beyond the adjacent outer edge of the shroud as shown in FIGS. 11 and 12 to lie juxtaposed to the second shroud fan stacked thereabove.

Figure 4:
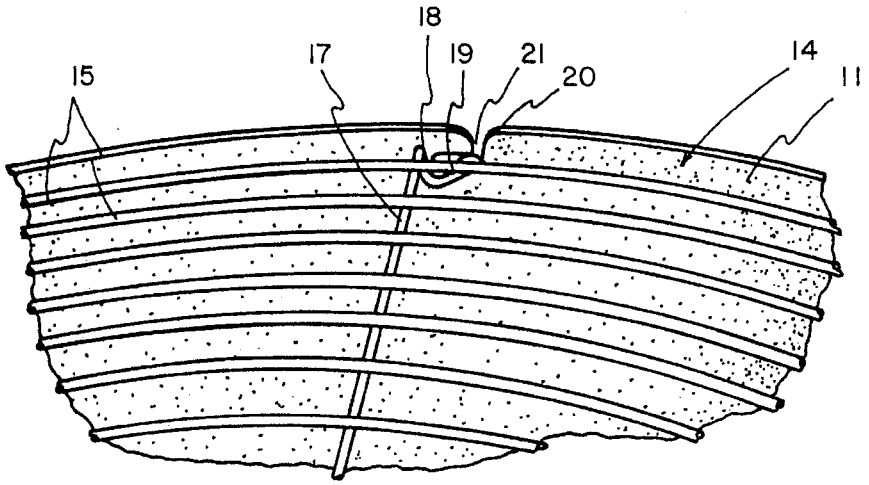
FIG. 4 is a perspective view with the guard hook engaging the shroud slot.
Figure 5:
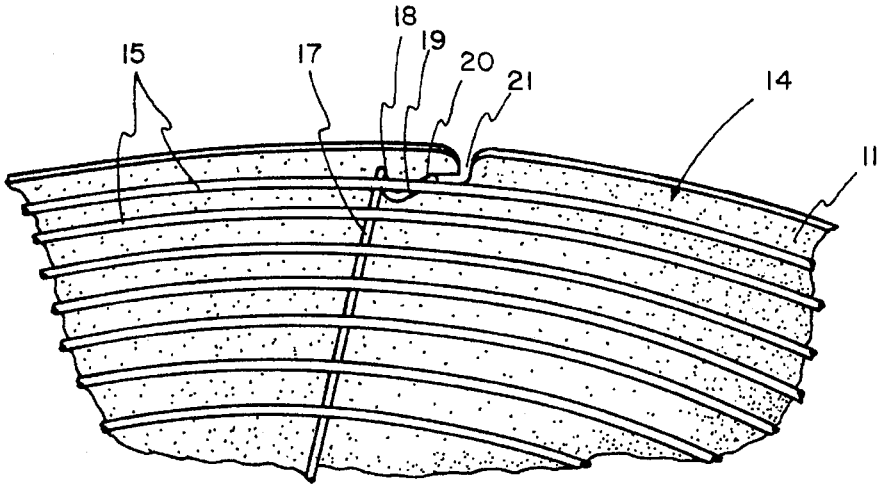
FIG. 5 is a perspective view of the guard in full engagement with the shroud.

To install the front and rear fan guards 14 of the present invention on shroud 11, such guards are disposed adjacent the shroud with the hook portions 20 on the end of the radial wires 17 in the entrance to the L-shaped slots 21. Hooks 20 are then pushed down into the L-shaped slot 21 as shown in FIG. 4. The entire fan guard 14 is then rotated to the left to lock the hook 20 in the bottom of the L-shaped slot 21 as shown clearly in FIG. 5. The hook portion 24 of the single radial wire 17 is then pushed up over opening 25 in connecting plate 12 and bolt 26 passed through such hook 24 and into opening 25. This bolt prevents the fan guard 14 from twisting relative to shroud 11 thus keeping the hook portions 20 firmly engaged in the L-shaped slots 21.

The configuration of the end of the radial arms 17 that engage the shroud slots 21, including the inward arm portion 18 and the outward arm portion 19 lying in a plane parallel to the plane of the interior of shroud 11 and lying juxtaposed thereto, gives added strength to the connection between the radial wires and the shroud.

Also, should the bolt 26 become disengaged from the opening 25 in connector plate 12, and the fan guard vibrate or otherwise rotate partially to the right, it will still be engaged with the shroud until it moves all the way to alignment with the entry opening in the L-shaped slot 21. This is an added safety feature and has great advantage by adding an additional safety factor for the user of the shrouded fan of the present invention.

Once the ends of the shroud 11 have been placed adjacent each other and the connecting plate 12 riveted to such ends as shown in FIG. 6, and the front and rear fan guards 14 are connected to the slots in the front and rear edges of such shroud with the bolt 26 in place to prevent undesirable rotating disconnection between the guards and the shroud, the fan 10 of the present invention is ready to use.

During the above assembly, a fan motor with its associated fan blades 16 is, of course, operatively mounted on the interior of said shroud. Since the mounting of fan motors and fan blades interior of a fan shroud is well known to those skilled in the art, further detailed discussion of the same is not deemed necessary.

Once the shroud fan 10 of the present invention has been assembled as described above, it can be stacked during storage as shown in FIG. 12. To do this, the tabs 36 are simply pivoted until they outwardly project from the shroud 11 along at least one edge thereof. The opposite edge is placed on the floor or other supporting structure 38. A second fan can then be stacked on top of the first as shown in FIG. 12 with the outwardly projecting tabs 36 lying juxtaposed to the interior and/or exterior surface of the shroud on the stacked fan as clearly illustrated in FIG. 11. The tabs on the upper edge of the second fan can then be pivoted until they project outwardly and a third fan can be stacked on the second fan, and so forth. Fans stacked in this manner can be readily stored as well as transported in such stacked position.

Once the fan 10 of the present invention arrives at the location where it will be used, it usually is mounted in one of two ways.

Figure 9:
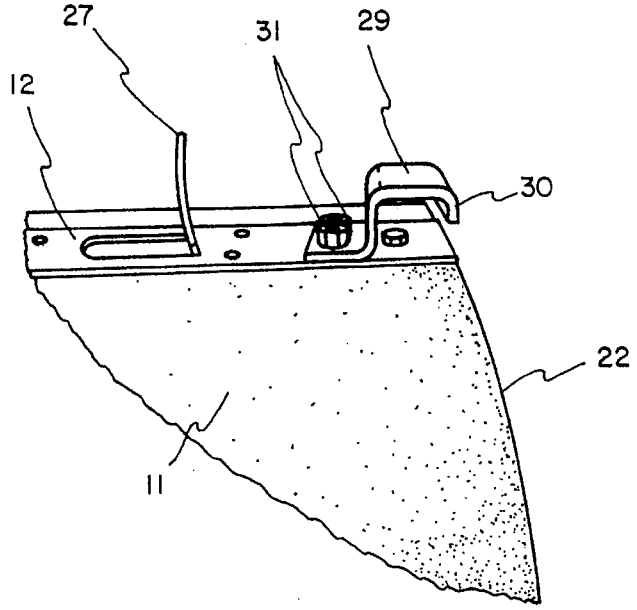
FIG. 9 is a enlarged detail view of the supporting hook.
Figure 10:
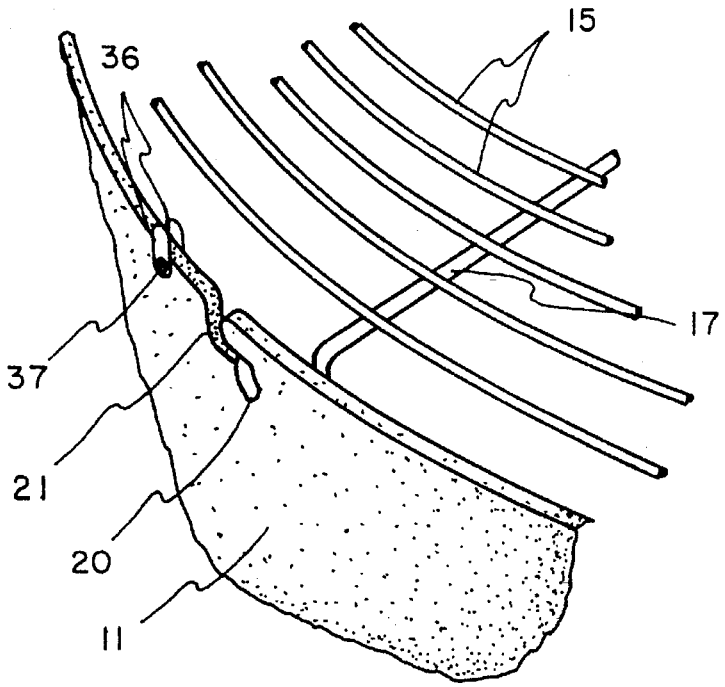
FIG. 10 is a perspective view of the pivotable shroud tab.

First, if the fan is to be used as a circulating fan, a screw driver or similar tool 39 is placed in the opening 28 of the two malleable tabs 27 at opposite ends of connecting plate 12 and they are bent upwardly as shown in FIGS. 7, 8 and 9. Hanger means such as chains, cables, rods or the like, indicated at 41, can be connected to the front and rear tabs to suspend the shroud fan so that it can be used as a circulating fan. When used in this configuration, the tabs 36 will be pivoted to the inside of the shroud 11 so they will be out of the way.

The second normal method of mounting the fan 10 is an exhaust fan where it is mounted in a circular opening in a square adapter plate made of polyethylene or similar material. A hanging hook 29 is secured to the connecting plate 12 by bolts 31 with the lip 30 outwardly projecting as clearly shown in FIG. 9. The Opening 32 in the adapter plate 33 is approximately the same diameter as the interior diameter of the shroud 11 so that such shroud will not pass through said opening. The lip 30 of hanging hook 29 is placed in slot 34 of angle bracket 35 above opening 32 in adapter plate 33. This hook 29 in engagement with bracket 35 supports the weight of the fan 10. The tabs 36 are outwardly projecting when mounting the fan on the adapter plate so they hold the shroud in the opening 32 and prevent such shroud from moving from side to side relative to such opening. In other words the tabs 36 stabilize the shroud fan 10 adjacent the opening 32 in adapter plate 33.

The fan 10 of the present invention can, of course, be mounted in other ways such as on a wheeled chassis to make the fan mobile, etc. The hanging tabs 27 as well as the pivotable tabs 36 can be used as required for mounting of such fan other as a circulating fan or an exhaust fan.

From the above it can be seen that the present invention has the advantage of providing an improved shroud fan with a quick attach fan guard that rotates or twist locks into place on the front and rear of the shroud. A connecting plate is used to secure the ends of the shroud together and malleable tabs are formed at each end thereof which can be bent outwardly and used to suspend the shroud of the fan when the same is used as a circulating fan. Hook means, a slotted angle bracket and pivotable tabs are used to wall mount the fan of the present invention through use of an adapter plate. The pivotable tabs can also be used to stack a plurality of fans and to maintain the alignment thereof during storage and shipment.

The terms "front end", "rear end", "ends", and so forth have been used herein merely for convenience to describe the present invention and its parts as oriented in the drawings. It is to be understood, however, that these terms are in no way limiting to the invention since such invention may obviously be disposed in different orientations when in use.

The present invention may, of course, be carried out in other specific ways than those herein set forth without departing from the spirit and essential characteristics of such invention. The present embodiments are, therefore, to be considered in all respects as illustrative and not restrictive, and all changes coming within the meaning and equivalency range of the appended claims are intended to be embraced therein.

What is claimed is:

1. An improved fan comprising: a generally air impervious circular shroud having front and rear edges surrounding a power driven fan blade; a plurality of generally L-shaped slot means formed in at least one of said edges; and a least one fan guard having a plurality of hook-like means mounted thereon for engaging said slot means whereby when said hook-like means of said fan guard are placed in said L-shaped slot means and said guard is rotated, said hook-like means will become locked in said slot means.

2. The improved fan of claim 1 including means For securing at least one of said hook-like means to said shroud whereby counter rotation of said fan guard within said L-shaped slot means is prevented.

3. The improved fan of claim 1 wherein said hook-like means mounted on said guard include bends with portions that lie in a juxtaposed parallel plane to a plane defining an interior surface of said shroud whereby rigidity is given to the connection between said hook-like means and said slot means.

4. The improved fan of claim 3 wherein the hook-like means mounted on the fan guard is bent at a 90 degree angle inwardly to form an inward arm portion and 60 degrees outwardly to form an outward arm portion, said inward arm portion and said outward arm portion both lying in a juxtaposed parallel plane to the plane of the interior of the shroud with the hook-like means formed on the end thereof for engaging the slot means whereby a sturdy connection between said fan guard and said shroud is provided.

5. The improved fan of claim 1 wherein said hook-like means mounted on said fan guard are formed in the end of radiating wires mounting a plurality of concentric rings.

6. An improved fan comprising: a generally air impervious circular shroud having two ends and surrounding a power driven fan blade; an elongated connecting plate secured to said ends of said shroud to hold such ends in juxtaposition; malleable tabs formed in each end of the elongated connecting plate, each of said tabs having an opening therein whereby when said tabs are bent outwardly, hanging means can be passed through said openings in said tabs to support the improved fan.

7. The improved fan of claim 6 wherein said malleable tabs are generally U-shaped in configuration.

8. The improved fan of claim 7 wherein said elongated connecting plate is formed from stainless steel.

9. An improved fan comprising: a generally air impervious circular shroud having front and rear edges surrounding a power driven fan blade; a plurality of tab means pivotably mounted on said shroud adjacent at least one of said edges whereby said tabs can be pivoted to extend outwardly from the shroud to hold a plurality of shrouded fans in a vertical stacked position.

10. The improved fan of claim 9 wherein a hanging means a hook means is mounted on said shroud adjacent the front edge thereof; an adapter plate having a circular opening therein; and a bracket having a slot therein mounted on said adapter plate adjacent said opening whereby said hook means can engage said slot in said bracket to support said shroud juxtaposed to said opening with said tabs extending into said opening to further stabilize the mounting of said shroud juxtaposed to said opening in said plate.

11. A method of mounting a fan guard on at least one edge of a fan shroud comprising: forming a plurality of slots, at least part of which have a generally L-shaped configuration, in at least one edge of said shroud; placing hook like means mounted on said fan guard in said slots; and rotating said guard relative to said shroud to lock the hook-like means in place in said slots.

12. The method of claim 11 wherein the step of rotating includes securing at least one of said hook-like means to said shroud to prevent said guard from counterrotatively disconnecting from said shroud.

13. The method of claim 12 wherein the step of securing is carried out by a bolt connection means.

14. The method of claim 11 wherein the hook-like means are bent at a 90 degree angle inwardly to form an inward arm portion and 60 degrees to form an outward arm portion such that said inward arm portion and said outward arm portion both lie in a juxtaposed parallel plane to the plane of the interior of the shroud whereby a sturdy connection between said fan guard and said shroud is provided.

* * * * *